US007789139B2

(12) United States Patent
Johnson

(10) Patent No.: US 7,789,139 B2
(45) Date of Patent: Sep. 7, 2010

(54) DEVICE AND SYSTEM FOR WELL COMPLETION AND CONTROL AND METHOD FOR COMPLETING AND CONTROLLING A WELL

(75) Inventor: Michael H. Johnson, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/144,406

(22) Filed: Jun. 23, 2008

(65) Prior Publication Data

US 2009/0101335 A1 Apr. 23, 2009

Related U.S. Application Data

(63) Continuation-in-part of application No. 11/875,584, filed on Oct. 19, 2007.

(60) Provisional application No. 61/052,919, filed on May 13, 2008.

(51) Int. Cl.
*E21B 43/08* (2006.01)

(52) U.S. Cl. ..... 166/205; 166/278

(58) Field of Classification Search ..... 166/55, 166/207, 212, 229, 278, 296, 373, 376, 205, 166/317

See application file for complete search history.

(56) References Cited

U.S. PATENT DOCUMENTS

| | | | | |
|---|---|---|---|---|
| 1,362,552 | A | 12/1920 | Alexander et al. | |
| 1,649,524 | A | 11/1927 | Hammond | |
| 1,915,867 | A | 6/1933 | Penick | |
| 1,984,741 | A | 12/1934 | Harrington | |
| 2,089,477 | A | 8/1937 | Halbert | |
| 2,119,563 | A | 6/1938 | Wells | |
| 2,214,064 | A | 9/1940 | Niles | |
| 2,257,523 | A | 9/1941 | Combs | |
| 2,391,609 | A * | 12/1945 | Wright | 166/228 |
| 2,412,841 | A | 12/1946 | Spangler | |
| 2,762,437 | A | 9/1956 | Egan et al. | |
| 2,810,352 | A | 10/1957 | Tumlison | |

(Continued)

FOREIGN PATENT DOCUMENTS

| | | |
|---|---|---|
| CN | 1385594 | 12/2002 |

(Continued)

OTHER PUBLICATIONS

Restarick, Henry; "Horizontal Completion Options in Reservoirs With Sand Problems"; SPE29831; SPE Middle East Oil Show, Bahrain; Mar. 11-14, 1995; pp. 545-560.

(Continued)

*Primary Examiner*—Daniel P Stephenson
(74) *Attorney, Agent, or Firm*—Cantor Colburn LLP

(57) ABSTRACT

A fluid media tell-tale configuration including a tubular having an inside surface with which a fluid media will make contact during application of the fluid media to a target destination. The fluid media tell-tale configuration further including one or more openings in the tubular having a beaded matrix therein. The beaded matrix being permeable to a fluid transport component of the fluid media while being impermeable to a residue component of the fluid media. A method for applying a fluid media to a target location with a tell-tale confirmation.

15 Claims, 6 Drawing Sheets

U.S. PATENT DOCUMENTS

| | | | |
|---|---|---|---|
| 2,814,947 | A | 12/1957 | Stegemeier et al. |
| 2,942,668 | A | 6/1960 | Maly et al. |
| 2,945,541 | A | 7/1960 | Maly et al. |
| 3,103,789 | A | 9/1963 | McDuff |
| 3,273,641 | A | 9/1966 | Bourne |
| 3,302,408 | A | 2/1967 | Schmid |
| 3,322,199 | A | 5/1967 | Van Note, Jr. |
| 3,326,291 | A | 6/1967 | Zandmer |
| 3,385,367 | A | 5/1968 | Kollsman |
| 3,386,508 | A | 6/1968 | Bielstein et al. |
| 3,419,089 | A | 12/1968 | Venghiattis |
| 3,451,477 | A | 6/1969 | Kelley |
| RE027,252 | E | 12/1971 | Sklar et al. |
| 3,675,714 | A | 7/1972 | Thompson |
| 3,739,845 | A | 6/1973 | Berry et al. |
| 3,791,444 | A | 2/1974 | Hickey |
| 3,876,471 | A | 4/1975 | Jones |
| 3,918,523 | A | 11/1975 | Stuber |
| 3,951,338 | A | 4/1976 | Genna |
| 4,173,255 | A | 11/1979 | Kramer |
| 4,180,132 | A | 12/1979 | Young |
| 4,186,100 | A | 1/1980 | Mott |
| 4,187,909 | A | 2/1980 | Erbstoesser |
| 4,248,302 | A | 2/1981 | Churchman |
| 4,250,907 | A | 2/1981 | Struckman et al. |
| 4,257,650 | A | 3/1981 | Allen |
| 4,265,485 | A | 5/1981 | Boxerman et al. |
| 4,287,952 | A | 9/1981 | Erbstoesser |
| 4,390,067 | A | 6/1983 | Willman |
| 4,415,205 | A | 11/1983 | Rehm et al. |
| 4,434,849 | A | 3/1984 | Allen |
| 4,463,988 | A | 8/1984 | Bouck et al. |
| 4,491,186 | A | 1/1985 | Alder |
| 4,497,714 | A | 2/1985 | Harris |
| 4,552,218 | A | 11/1985 | Ross et al. |
| 4,572,295 | A | 2/1986 | Walley |
| 4,614,303 | A | 9/1986 | Moseley, Jr. et al. |
| 4,649,996 | A | 3/1987 | Kojicic et al. |
| 4,821,800 | A | 4/1989 | Scott et al. |
| 4,856,590 | A | 8/1989 | Caillier |
| 4,917,183 | A | 4/1990 | Gaidry et al. |
| 4,944,349 | A | 7/1990 | Von Gonten, Jr. |
| 4,974,674 | A | 12/1990 | Wells |
| 4,998,585 | A | 3/1991 | Newcomer et al. |
| 5,004,049 | A | 4/1991 | Arterbury |
| 5,016,710 | A | 5/1991 | Renard et al. |
| 5,132,903 | A | 7/1992 | Sinclair |
| 5,156,811 | A | 10/1992 | White |
| 5,217,076 | A | 6/1993 | Masek |
| 5,333,684 | A | 8/1994 | Walter et al. |
| 5,337,821 | A | 8/1994 | Peterson |
| 5,339,895 | A | 8/1994 | Arterbury et al. |
| 5,339,897 | A | 8/1994 | Leaute |
| 5,355,956 | A | 10/1994 | Restarick |
| 5,377,750 | A | 1/1995 | Arterbury et al. |
| 5,381,864 | A | 1/1995 | Nguyen et al. |
| 5,384,046 | A | 1/1995 | Lotter et al. |
| 5,431,346 | A | 7/1995 | Sinaisky |
| 5,435,393 | A | 7/1995 | Brekke et al. |
| 5,435,395 | A | 7/1995 | Connell |
| 5,439,966 | A | 8/1995 | Graham et al. |
| 5,551,513 | A | 9/1996 | Surles et al. |
| 5,586,213 | A | 12/1996 | Bridges et al. |
| 5,597,042 | A | 1/1997 | Tubel et al. |
| 5,609,204 | A | 3/1997 | Rebardi et al. |
| 5,673,751 | A | 10/1997 | Head et al. |
| 5,803,179 | A | 9/1998 | Echols et al. |
| 5,829,520 | A | 11/1998 | Johnson |
| 5,831,156 | A | 11/1998 | Mullins |
| 5,839,508 | A | 11/1998 | Tubel et al. |
| 5,873,410 | A | 2/1999 | Iato et al. |
| 5,881,809 | A | 3/1999 | Gillespie et al. |
| 5,896,928 | A | 4/1999 | Coon |
| 5,982,801 | A | 11/1999 | Deak |
| 6,044,869 | A | 4/2000 | Koob |
| 6,068,015 | A | 5/2000 | Pringle |
| 6,098,020 | A | 8/2000 | Den Boer |
| 6,112,815 | A | 9/2000 | Bøe et al. |
| 6,112,817 | A | 9/2000 | Voll et al. |
| 6,119,780 | A | 9/2000 | Christmas |
| 6,228,812 | B1 | 5/2001 | Dawson et al. |
| 6,253,847 | B1 | 7/2001 | Stephenson |
| 6,253,861 | B1 | 7/2001 | Carmichael et al. |
| 6,273,194 | B1 | 8/2001 | Hiron et al. |
| 6,305,470 | B1 | 10/2001 | Woie |
| 6,325,152 | B1 | 12/2001 | Kelley et al. |
| 6,338,363 | B1 | 1/2002 | Chen et al. |
| 6,367,547 | B1 | 4/2002 | Towers et al. |
| 6,371,210 | B1 | 4/2002 | Bode et al. |
| 6,372,678 | B1 | 4/2002 | Youngman et al. |
| 6,419,021 | B1 | 7/2002 | George et al. |
| 6,474,413 | B1 | 11/2002 | Barbosa et al. |
| 6,505,682 | B2 | 1/2003 | Brockman |
| 6,516,888 | B1 | 2/2003 | Gunnarson et al. |
| 6,530,431 | B1 | 3/2003 | Castano-Mears et al. |
| 6,561,732 | B1 | 5/2003 | Bloomfield et al. |
| 6,581,681 | B1 | 6/2003 | Zimmerman et al. |
| 6,581,682 | B1 | 6/2003 | Parent et al. |
| 6,622,794 | B2 | 9/2003 | Zisk, Jr. |
| 6,632,527 | B1 | 10/2003 | McDaniel et al. |
| 6,635,732 | B2 | 10/2003 | Mentak |
| 6,667,029 | B2 | 12/2003 | Zhong et al. |
| 6,679,324 | B2 | 1/2004 | Den Boer et al. |
| 6,692,766 | B1 | 2/2004 | Rubinstein et al. |
| 6,699,503 | B1 | 3/2004 | Sako et al. |
| 6,699,611 | B2 | 3/2004 | Kim et al. |
| 6,722,437 | B2 | 4/2004 | Vercaemer et al. |
| 6,786,285 | B2 | 9/2004 | Johnson et al. |
| 6,817,416 | B2 | 11/2004 | Wilson et al. |
| 6,830,104 | B2 | 12/2004 | Nguyen et al. |
| 6,831,044 | B2 | 12/2004 | Constien |
| 6,840,321 | B2 | 1/2005 | Restarick et al. |
| 6,857,476 | B2 | 2/2005 | Richards |
| 6,863,126 | B2 | 3/2005 | McGlothen et al. |
| 6,896,049 | B2 | 5/2005 | Moyes |
| 6,938,698 | B2 | 9/2005 | Coronado |
| 6,951,252 | B2 | 10/2005 | Restarick et al. |
| 6,976,542 | B2 | 12/2005 | Henriksen et al. |
| 7,011,076 | B1 | 3/2006 | Weldon et al. |
| 7,032,675 | B2 | 4/2006 | Steele et al. |
| 7,084,094 | B2 | 8/2006 | Gunn et al. |
| 7,159,656 | B2 | 1/2007 | Eoff et al. |
| 7,185,706 | B2 | 3/2007 | Freyer |
| 7,258,166 | B2 | 8/2007 | Russell |
| 7,290,606 | B2 | 11/2007 | Coronado et al. |
| 7,290,610 | B2 | 11/2007 | Corbett et al. |
| 7,318,472 | B2 | 1/2008 | Smith |
| 7,322,412 | B2 | 1/2008 | Badalamenti et al. |
| 7,325,616 | B2 | 2/2008 | Lopez de Cardenas et al. |
| 7,360,593 | B2 | 4/2008 | Constien |
| 7,395,858 | B2 | 7/2008 | Barbosa et al. |
| 7,398,822 | B2 | 7/2008 | Meijer et al. |
| 7,409,999 | B2 | 8/2008 | Henriksen et al. |
| 7,413,022 | B2 | 8/2008 | Broome et al. |
| 7,451,814 | B2 | 11/2008 | Graham et al. |
| 7,469,743 | B2 | 12/2008 | Richards |
| 7,621,326 | B2 | 11/2009 | Crichlow |
| 7,644,854 | B1 | 1/2010 | Holmes et al. |
| 2002/0125009 | A1 | 9/2002 | Wetzel et al. |
| 2002/0148610 | A1 | 10/2002 | Bussear et al. |
| 2003/0221834 | A1 | 12/2003 | Hess et al. |
| 2004/0052689 | A1 | 3/2004 | Yao |
| 2004/0060705 | A1 | 4/2004 | Kelley |
| 2004/0144544 | A1 | 7/2004 | Freyer |

| | | | | |
|---|---|---|---|---|
| 2004/0159447 | A1 | 8/2004 | Bissonnette et al. | |
| 2004/0194971 | A1 | 10/2004 | Thomson | |
| 2005/0016732 | A1 | 1/2005 | Brannon et al. | |
| 2005/0086807 | A1 | 4/2005 | Richard et al. | |
| 2005/0126776 | A1* | 6/2005 | Russell | 166/229 |
| 2005/0178705 | A1 | 8/2005 | Broyles et al. | |
| 2005/0189119 | A1 | 9/2005 | Gynz-Rekowski | |
| 2005/0199298 | A1 | 9/2005 | Farrington | |
| 2005/0207279 | A1 | 9/2005 | Chemali et al. | |
| 2005/0241835 | A1 | 11/2005 | Burris et al. | |
| 2006/0042798 | A1 | 3/2006 | Badalamenti et al. | |
| 2006/0048936 | A1 | 3/2006 | Fripp et al. | |
| 2006/0048942 | A1 | 3/2006 | Moen et al. | |
| 2006/0076150 | A1 | 4/2006 | Coronado et al. | |
| 2006/0086498 | A1 | 4/2006 | Wetzel et al. | |
| 2006/0108114 | A1* | 5/2006 | Johnson | 166/276 |
| 2006/0118296 | A1 | 6/2006 | Dybevik et al. | |
| 2006/0124360 | A1 | 6/2006 | Lee et al. | |
| 2006/0157242 | A1 | 7/2006 | Graham et al. | |
| 2006/0175065 | A1 | 8/2006 | Ross | |
| 2006/0185849 | A1 | 8/2006 | Edwards et al. | |
| 2006/0250274 | A1 | 11/2006 | Mombourquette et al. | |
| 2006/0272814 | A1 | 12/2006 | Broome et al. | |
| 2007/0012444 | A1 | 1/2007 | Horgan et al. | |
| 2007/0039741 | A1 | 2/2007 | Hailey, Jr. | |
| 2007/0044962 | A1 | 3/2007 | Tibbles | |
| 2007/0131434 | A1 | 6/2007 | MacDougall et al. | |
| 2007/0181299 | A1 | 8/2007 | Chung et al. | |
| 2007/0246210 | A1 | 10/2007 | Richards | |
| 2007/0246213 | A1 | 10/2007 | Hailey, Jr. | |
| 2007/0246225 | A1 | 10/2007 | Hailey, Jr. et al. | |
| 2007/0246407 | A1 | 10/2007 | Richards et al. | |
| 2008/0035350 | A1 | 2/2008 | Henriksen et al. | |
| 2008/0053662 | A1 | 3/2008 | Williamson et al. | |
| 2008/0135249 | A1 | 6/2008 | Fripp et al. | |
| 2008/0149323 | A1 | 6/2008 | O'Malley et al. | |
| 2008/0149351 | A1 | 6/2008 | Marya et al. | |
| 2008/0169099 | A1 | 7/2008 | Pensgaard | |
| 2008/0236839 | A1 | 10/2008 | Oddie | |
| 2008/0236843 | A1 | 10/2008 | Scott et al. | |
| 2008/0283238 | A1 | 11/2008 | Richards et al. | |
| 2008/0296023 | A1 | 12/2008 | Willauer | |
| 2008/0314590 | A1 | 12/2008 | Patel | |
| 2009/0056816 | A1 | 3/2009 | Arov et al. | |
| 2009/0057014 | A1 | 3/2009 | Richard et al. | |
| 2009/0101342 | A1 | 4/2009 | Gaudette et al. | |
| 2009/0133869 | A1 | 5/2009 | Clem | |
| 2009/0133874 | A1 | 5/2009 | Dale et al. | |
| 2009/0139272 | A1 | 6/2009 | Tanju et al | |
| 2009/0139717 | A1 | 6/2009 | Richard et al. | |
| 2009/0205834 | A1 | 8/2009 | Garcia et al. | |
| 2009/0301704 | A1 | 12/2009 | Dillett et al. | |

FOREIGN PATENT DOCUMENTS

| | | |
|---|---|---|
| GB | 1492345 | 6/1976 |
| GB | 2341405 | 3/2000 |
| JP | 59089383 | 5/1984 |
| SU | 1335677 | 8/1985 |
| WO | 9403743 | 2/1994 |
| WO | 0079097 | 12/2000 |
| WO | 0165063 | 9/2001 |
| WO | 0177485 | 10/2001 |
| WO | 02075110 | 9/2002 |
| WO | 2004018833 A1 | 3/2004 |
| WO | 2006015277 | 2/2006 |

OTHER PUBLICATIONS

Richard, Bennett M., et al.; U.S. Appl. No. 11/949,403; "Multi-Position Valves for Fracturing and Sand Control and Associated Completion Methods", Filed in the United States Patent and Trademark Office Dec. 3, 2007. Specification Having 13 Pages and Drawings Having 11 Sheets.

"Rapid Swelling and Deswelling of Thermoreversible Hydrophobically Modified Poly (N-Isopropylacrylamide) Hydrogels Prepared by freezing Polymerisation", Xue, W., Hamley, I.W. and Huglin, M.B., 2002, 43(1) 5181-5186.

"Thermoreversible Swelling Behavior of Hydrogels Based on N-Isopropylacrylamide with a Zwitterionic Comonomer". Xue, W., Champ, S. and Huglin, M.B. 2001, European Polymer Journal, 37(5) 869-875.

An Oil Selective Inflow Control System; Rune Freyer, Easy Well Solutions: Morten Fejerskkov, Norsk Hydro; Arve Huse, Altinex; European Petroleum Conference, Oct. 29-31, Aberdeen, United Kingdom, Copyright 2002, Society of Petroleum Engineers, Inc.

Baker Oil Tools, Product Report, Sand Control Systems: Screens, Equalizer CF Product Family No. H48688. Nov. 2005. 1 page.

Bercegeay, E. P., et al. "A One-Trip Gravel Packing System," SPE 4771, New Orleans, Louisiana, Feb. 7-8, 1974. 12 pages.

Burkill, et al. Selective Steam Injection in Open hole Gravel-packed Liner Completions SPE 595.

Concentric Annular Pack Screen (CAPS) Service; Retrieved From Internet on Jun. 18, 2008. http://www.halliburton.com/ps/Default.aspx?navid=81&pageid=273&prodid=PRN%3a%3aIQSHFJ2QK.

Determination of Perforation Schemes to Control Production and Injection Profiles Along Horizontal; Asheim, Harald, Norwegian Institute of Technology; Oudeman, Pier, Koninklijke/Shell Exploratie en Producktie Laboratorium; SPE Drilling and Completion, vol. 12, No. 1, March; pp. 13-18; 1997 Society of Petroleum Engieneers.

Dikken, Ben J., SPE, Koninklijke/Shell E&P Laboratorium; "Pressure Drop in Horizontal Wells and Its Effect on Production Performance"; Nov. 1990, JPT; Copyright 1990, Society of Petroleum Engineers; pp. 1426-1433.

Dinarvand. R., D'Emanuele, A (1995) The use of thermoresponsive hydrogels for on-off release of molecules, J. Control. Rel. 36 221-227.

E.L. Joly, et al. New Production Logging Technique for Horizontal Wells. SPE 14463 1988.

Hackworth, et al. "Development and First Application of Bistable Expandable Sand Screen," Society of Petroleum Engineers: SPE 84265. Oct. 5-8, 2003. 14 pages.

Ishihara, K., Hamada, N., Sato, S., Shinohara, I., (1984) Photoinduced swelling control of amphiphdilic azoaromatic polymer membrane. J. Polym. Sci., Polm. Chem. Ed. 22: 121-128.

Mathis, Stephen P. "Sand Management: A Review of Approaches and Conerns," SPE 82240, The Hague, The Netherlands, May 13-14, 2003. 7 pages.

Optimization of Commingled Production Using Infinitely Variable Inflow Control Valves; M.M, J.J. Naus, Delft University of Technology (DUT), Shell International Exploration and production (SIEP); J.D. Jansen, DUT and SIEP; SPE Annual Technical Conference and Exhibtion, Sep. 26-29 Houston, Texas, 2004, Society of Patent Engineers.

Pardo, et al. "Completion, Techniques Used in Horizontal Wells Drilled in Shallow Gas Sands in the Gulf of Mexio". SPE 24842. Oct. 4-7, 1992.

R. D. Harrison Jr., et al. Case Histories: New Horizontal Completion Designs Facilitate Development and Increase Production Capabilites in Sandstone Reservoirs. SPE 27890. Wester Regional Meeting held in Long Beach, CA Mar. 23-25, 1994.

Tanaka, T., Ricka, J., (1984) Swelling of Ionic gels: Quantitative performance of the Donnan Thory, Macromolecules, 17, 2916-2921.

Tanaka, T., Nishio, I., Sun, S.T., Uena-Nisho, S. (1982) Collapse of gels in an electric field, Science, 218-467-469.

International Search Report and Written Opinion, Mailed Feb. 2, 2010, International Appln. No. PCT/US2009/049661, Written Opinion 7 pages, International Search Report 3 pages.

* cited by examiner

DEVICE AND SYSTEM FOR WELL COMPLETION AND CONTROL AND METHOD FOR COMPLETING AND CONTROLLING A WELL

CROSS REFERENCE TO RELATED APPLICATION

The present application claims priority to U.S. Provisional Patent Application Ser. No. 61/052,919, filed May 13, 2008, and U.S. patent application Ser. No. 11/875,584, filed Oct. 19, 2007, the entire contents of which are specifically incorporated herein by reference.

BACKGROUND

Well completion and control are the most important aspects of hydrocarbon recovery short of finding hydrocarbon reservoirs to begin with. A host of problems are associated with both wellbore completion and control. Many solutions have been offered and used over the many years of hydrocarbon production and use. While clearly such technology has been effective, allowing the world to advance based upon hydrocarbon energy reserves, new systems and methods are always welcome to reduce costs or improve recovery or both.

SUMMARY

A fluid media tell-tale configuration including a tubular having an inside surface with which a fluid media will make contact during application of the fluid media to a target destination. The fluid media tell-tale configuration further including one or more openings in the tubular having a beaded matrix therein. The beaded matrix being permeable to a fluid transport component of the fluid media while being impermeable to a residue component of the fluid media.

A method for applying a fluid media to a target location with a tell-tale confirmation. The method including pumping a fluid media to a target location and urging the fluid to one or more openings in a tubular having a beaded matrix therein. The beaded matrix being permeable to a transport portion of the fluid media and impermeable to a residue portion of the fluid media. The method further including monitoring the fluid media for a pressure increase.

BRIEF DESCRIPTION OF THE DRAWINGS

Referring now to the drawings wherein like elements are numbered alike in the several Figures.

DETAILED DESCRIPTION

Figure 1:
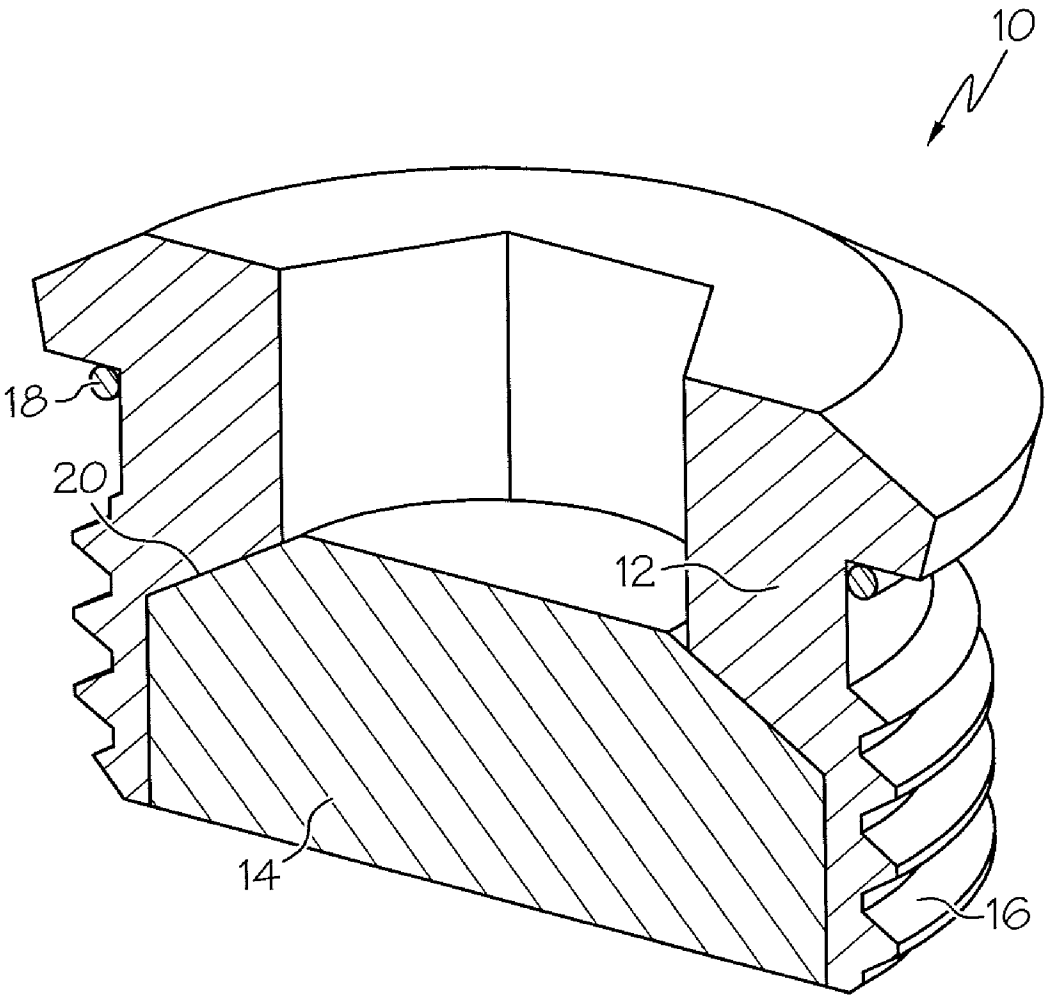
FIG. 1 is a perspective sectional view of a plug as disclosed herein.

Referring to FIG. 1, a beaded matrix plug flow control device 10 includes a plug housing 12 and a permeable material (sometimes referred to as beaded matrix) 14 disposed therein. The housing 12 includes in one embodiment a thread 16 disposed at an outside surface of the housing 12, but it is to be understood that any configuration providing securement to another member including welding is contemplated. In addition, some embodiments will include an o-ring or similar sealing structure 18 about the housing 12 to engage a separate structure such as a tubular structure with which the device 10 is intended to be engaged. In the FIG. 1 embodiment, a bore disposed longitudinally through the device is of more than one diameter (or dimension if not cylindrical). This creates a shoulder 20 within the inside surface of the device 10. While it is not necessarily required to provide the shoulder 20, it can be useful in applications where the device is rendered temporarily impermeable and might experience differential pressure thereacross. Impermeability of matrix 14 and differential pressure capability of the devices is discussed more fully later in this disclosure.

The matrix itself is described as "beaded" since the individual "beads" 30 are rounded though not necessarily spherical. A rounded geometry is useful primarily in avoiding clogging of the matrix 14 since there are few edges upon which debris can gain purchase.

The beads 30 themselves can be formed of many materials such as ceramic, glass, metal, etc. without departing from the scope of the disclosure. Each of the materials indicated as examples, and others, has its own properties with respect to resistance to conditions in the downhole environment and so may be selected to support the purposes to which the devices 10 will be put. The beads 30 may then be joined together (such as by sintering, for example) to form a mass (the matrix 14) such that interstitial spaces are formed therebetween providing the permeability thereof In some embodiments, the beads will be coated with another material for various chemical and/or mechanical resistance reasons. One embodiment utilizes nickel as a coating material for excellent wear resistance and avoidance of clogging of the matrix 14. Further, permeability of the matrix tends to be substantially better than a gravel or sand pack and therefore pressure drop across the matrix 14 is less than the mentioned constructions. In another embodiment, the beads are coated with a highly hydrophobic coating that works to exclude water in fluids passing through the device 10.

In addition to coatings or treatments that provide activity related to fluids flowing through the matrix 14, other materials may be applied to the matrix 14 to render the same temporarily (or permanently if desired) impermeable.

Each or any number of the devices 10 can easily be modified to be temporarily (or permanently) impermeable by injecting a hardenable (or other property causing impermeability) substance 26 such as a bio-polymer into the interstices of the beaded matrix 14 (see FIG. 3 for a representation of devices 10 having a hardenable substance therein). Determination of the material to be used is related to temperature and length of time for undermining (dissolving, disintegrating, fluidizing, subliming, etc) of the material desired. For example, Polyethylene Oxide (PEO) is appropriate for temperatures up to about 200 degrees Fahrenheit, Polywax for temperatures up to about 180 degrees Fahrenheit; PEO/Polyvinyl Alcohol (PVA) for temperatures up to about 250 degrees Fahrenheit; Polylactic Acid (PLA) for temperatures above 250 degrees Fahrenheit; among others. These can be dissolved using acids such as Sulfamic Acid, Glucono delta lactone, Polyglycolic Acid, or simply by exposure to the downhole environment for a selected period, for example. In one embodiment, Polyvinyl Chloride (PVC) is rendered molten or at least relatively soft and injected into the interstices of the beaded matrix and allowed to cool. This can be accomplished at a manufacturing location or at another controlled location such as on the rig. It is also possible to treat the devices in the downhole environment by pumping the hardenable material into the devices in situ. This can be done selectively or collectively of the devices 10 and depending upon the material selected to reside in the interstices of the devices; it can be rendered soft enough to be pumped directly from the surface or other remote location or can be supplied via a tool run to the vicinity of the devices and having the capability of heating the material adjacent the devices. In either case, the material is then applied to the devices. In such condition, the device 10 will hold a substantial pressure differential that may exceed 10,000 PSI.

The PVC, PEO, PVA, etc. can then be removed from the matrix 14 by application of an appropriate acid or over time as selected. As the hardenable material is undermined, target fluids begin to flow through the devices 10 into a tubular 40 in which the devices 10 are mounted. Treating of the hardenable substance may be general or selective. Selective treatment is by, for example, spot treating, which is a process known to the industry and does not require specific disclosure with respect to how it is accomplished.

In a completion operation, the temporary plugging of the devices can be useful to allow for the density of the string to be reduced thereby allowing the string to "float" into a highly deviated or horizontal borehole. This is because a lower density fluid (gas or liquid) than borehole fluid may be used to fill the interior of the string and will not leak out due to the hardenable material in the devices. Upon conclusion of completion activities, the hardenable material may be removed from the devices to facilitate production through the completion string.

Another operational feature of temporarily rendering impermeable the devices 10 is to enable the use of pressure actuated processes or devices within the string. Clearly, this cannot be accomplished in a tubular with holes in it. Due to the pressure holding capability of the devices 10 with the hardenable material therein, pressure actuations are available to the operator. One of the features of the devices 10 that assists in pressure containment is the shoulder 20 mentioned above. The shoulder 20 provides a physical support for the matrix 14 that reduces the possibility that the matrix itself could be pushed out of the tubular in which the device 10 resides.

In some embodiments, this can eliminate the use of sliding sleeves. In addition, the housing 12 of the devices 10 can be configured with mini ball seats so that mini balls pumped into the wellbore will seat in the devices 10 and plug them for various purposes.

As has been implied above and will have been understood by one of ordinary skill in the art, each device 10 is a unit that can be utilized with a number of other such units having the same permeability or different permeabilities to tailor inflow capability of the tubular 40, which will be a part of a string (not shown) leading to a remote location such as a surface location. By selecting a pattern of devices 10 and a permeability of individual devices 10, flow of fluid either into (target hydrocarbons) or out of (steam injection, etc.) the tubular can be controlled to improve results thereof Moreover, with appropriate selection of a device 10 pattern a substantial retention of collapse, burst and torsional strength of the tubular 40 is retained. Such is so much the case that the tubular 40 can be itself used to drill into the formation and avoid the need for an after run completion string.

Figure 4:
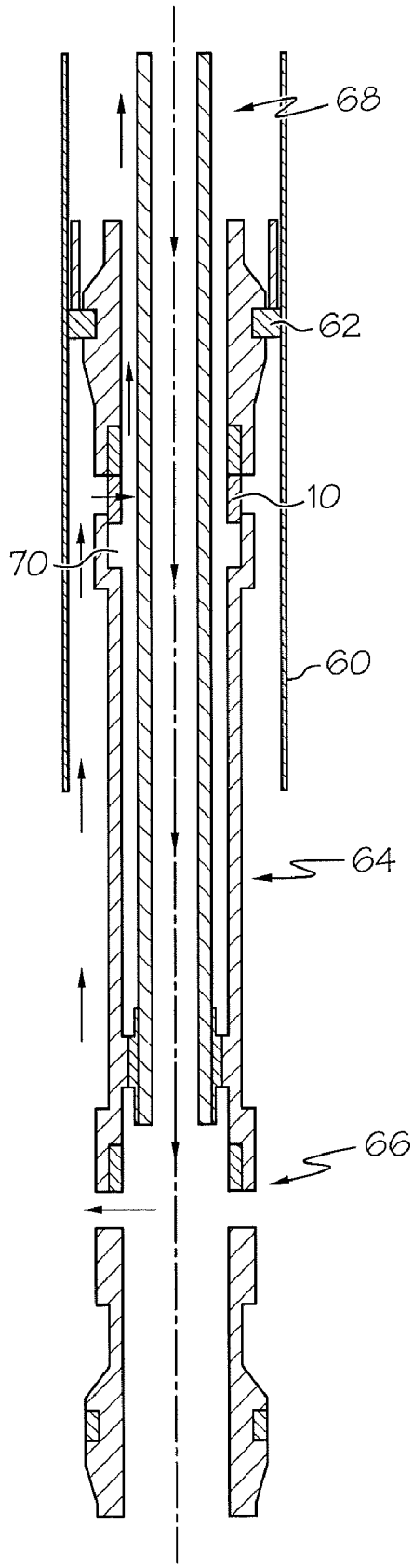
FIG. 4 is a schematic view of a tubular with a plurality of devices disposed therein and flow lines indicating the movement of a fluid such as cement filling an annular space.

In another utility, referring to FIG. 4, the devices 10 are usable as a tell tale for the selective installation of fluid media such as, for example, cement. Devices 10 are configured to allow passage of a transport portion of a fluid media and to exclude what will be named for purposes hereof a residue portion of the fluid media. It is to be understood that the transport portion of the fluid media may comprise one or more individual components itself while the residue portion may also comprise one or more components itself. By selectively excluding passage of the residue component, a pressure increase will be experienced in the system applying the fluid media that can be detected to indicate conclusion or other milestone of an operation. In the illustration, a casing 60 having a liner hanger 62 disposed therein supports a liner 64. The liner 64 includes a cement sleeve 66 and a number of devices 10 (two shown). Within the liner 64 is disposed a workstring 68 that is capable of supplying cement to an annulus of the liner 64 through the cement sleeve 66. In this case, the devices 10 are configured to allow passage of mud and a transport portion of the cement (for example, water) through the matrix 14 to an annular space 70 between the liner 64 and the workstring 68 while excluding passage of the residue component of the cement. By allowing mud to pass, the application process and structure is simplified because a slug of cement can be added without the need for cement plugs common in the art to maintain separation of the mud from the cement. In this system, because mud can pass while the residue portion cannot, the mud will be re-extracted from the cement if indeed any of the mud becomes mixed with the cement during pumping of the cement downhole. Separation of the transport portion and the residue portion is accomplished by either tailoring the matrix 14 of the specific devices 10 to exclude the residue component (chemically, e.g. using hydrophobicity or physically) of the cement or by tailoring the devices 10 to facilitate bridging of particulate matter added to the fluid media residue portion. In either case, for this example, since the mud and the transport component of the cement will pass through the devices 10 and the residue component of the cement will not, the pressure rise noted above is seen at the surface, or other control location, when the residue component of the cement reaches the devices 10 whereby the operator is alerted to the fact that the cement has now reached its destination and the operation is complete. The foregoing configuration can be configured for use with an open passageway for the fluid media to gain access to the target location or can utilize devices 10 for both the entrance access to the target location and the passage back in for the transport component of the fluid media. If the devices are used on both ends of the fluid media flow pathway, the entrance devices will of course need to be permeable to the ultimate residue component as well as the transport component. In such a configuration, there is no open passageway for anything to enter the assembly prior to pumping. In an alternate configuration, the devices 10 may be selected so as to pass cement from inside to outside the tubular in some locations while not admitting cement to pass in either direction at other locations. This is accomplished by manufacturing the beaded matrix 14 to possess interstices that are large enough for passage of the cement where it is desired that cement passes the devices and too small to allow passage of the solid content of the cement at other locations. Clearly, the grain size of a particular type of cement is known. Thus if one creates a matrix 14 having an interstitial space that is smaller than the grain size, the cement will not pass but will rather be stopped against the matrix 14 causing a pressure rise. In this type configuration, one can simultaneously cause cement to move into different spaces that may not communicate with each other. All that is necessary is that a device configured for passage and a device configured for exclusion be paired in each target space. To allow fluid media (e.g. cement) into the space but not out again.

Figure 5:
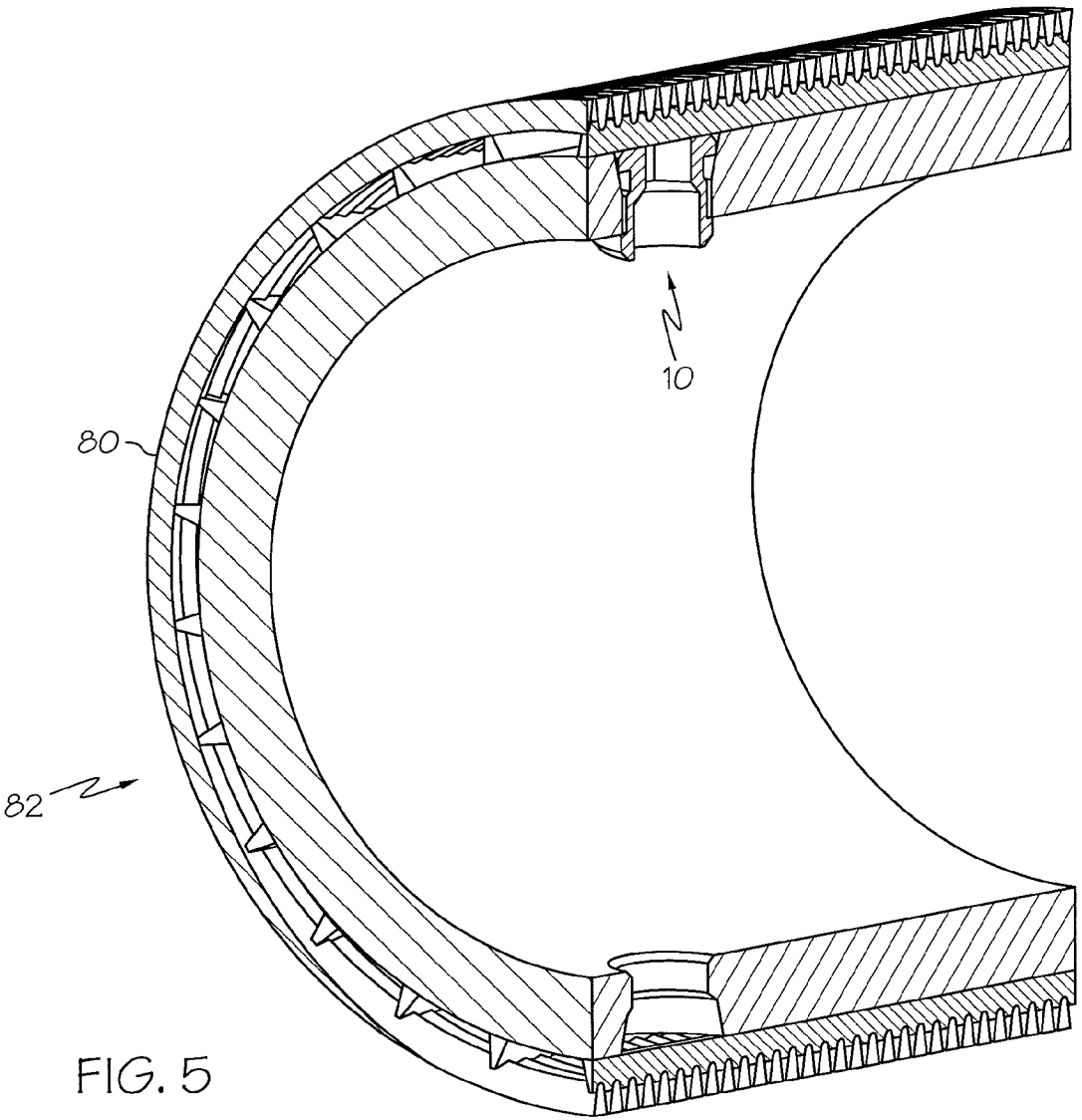
FIG. 5 is a schematic sectional view of a tubular with a plurality of devices disposed therein and a sand screen disposed therearound.

In another embodiment, the devices 10 in tubular 40 are utilized to supplement the function of a screen 80. This is illustrated in FIG. 5. Screens, it is known, cannot support any significant differential pressure without suffering catastrophic damage thereto. Utilizing the devices 10 as disclosed herein, however, a screen segment 82 can be made pressure differential insensitive by treating the devices 10 with a hardenable material as discussed above. The function of the screen can then be fully restored by dissolution or otherwise undermining of the hardenable material in the devices 10.

Figure 2:
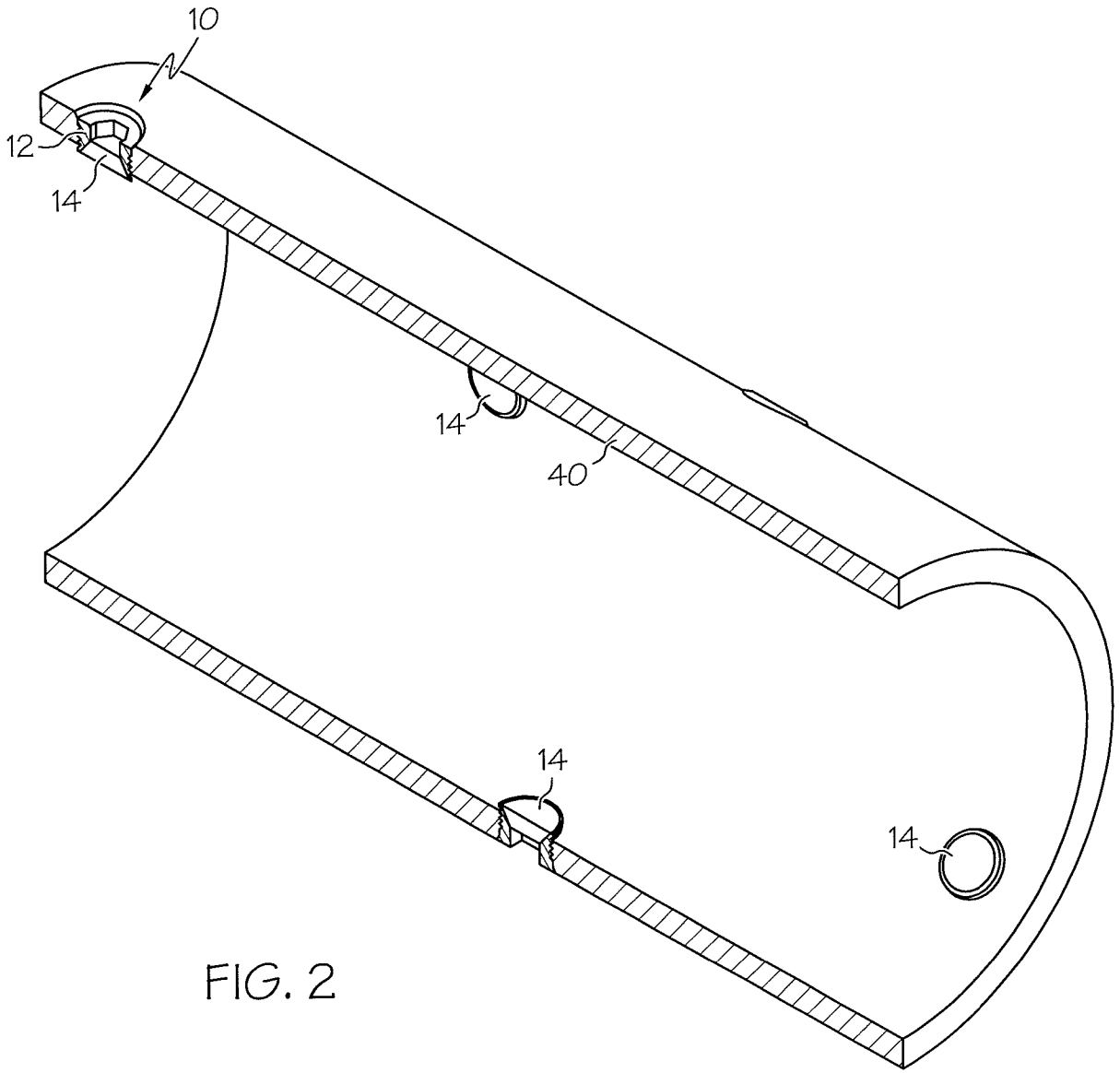
FIG. 2 is a schematic sectional illustration of a tubular member having a plurality of the plugs of FIG. 1 installed therein.
Figure 3A:
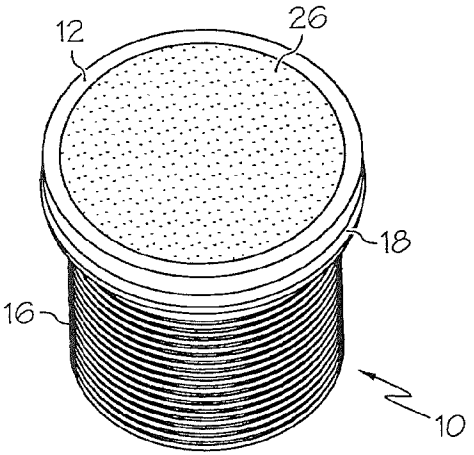
FIGS. 3A-3D are sequential views of a device having a hardenable and underminable substance therein to hold differential pressure and illustrating the undermining of the material.
Figure 3B:
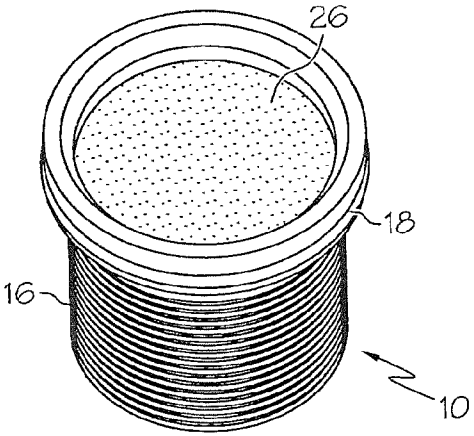
Figure 3C:
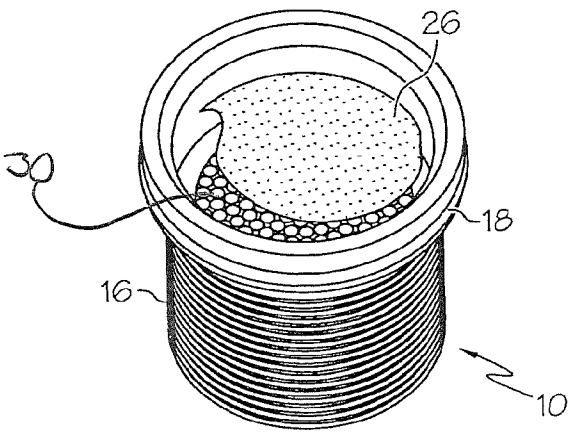
Figure 3D:
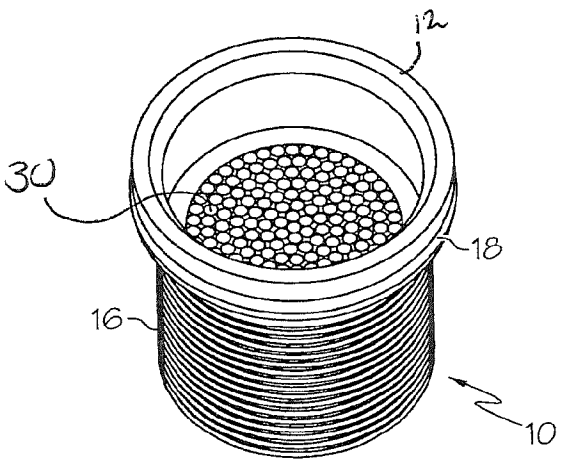
Figure 6:
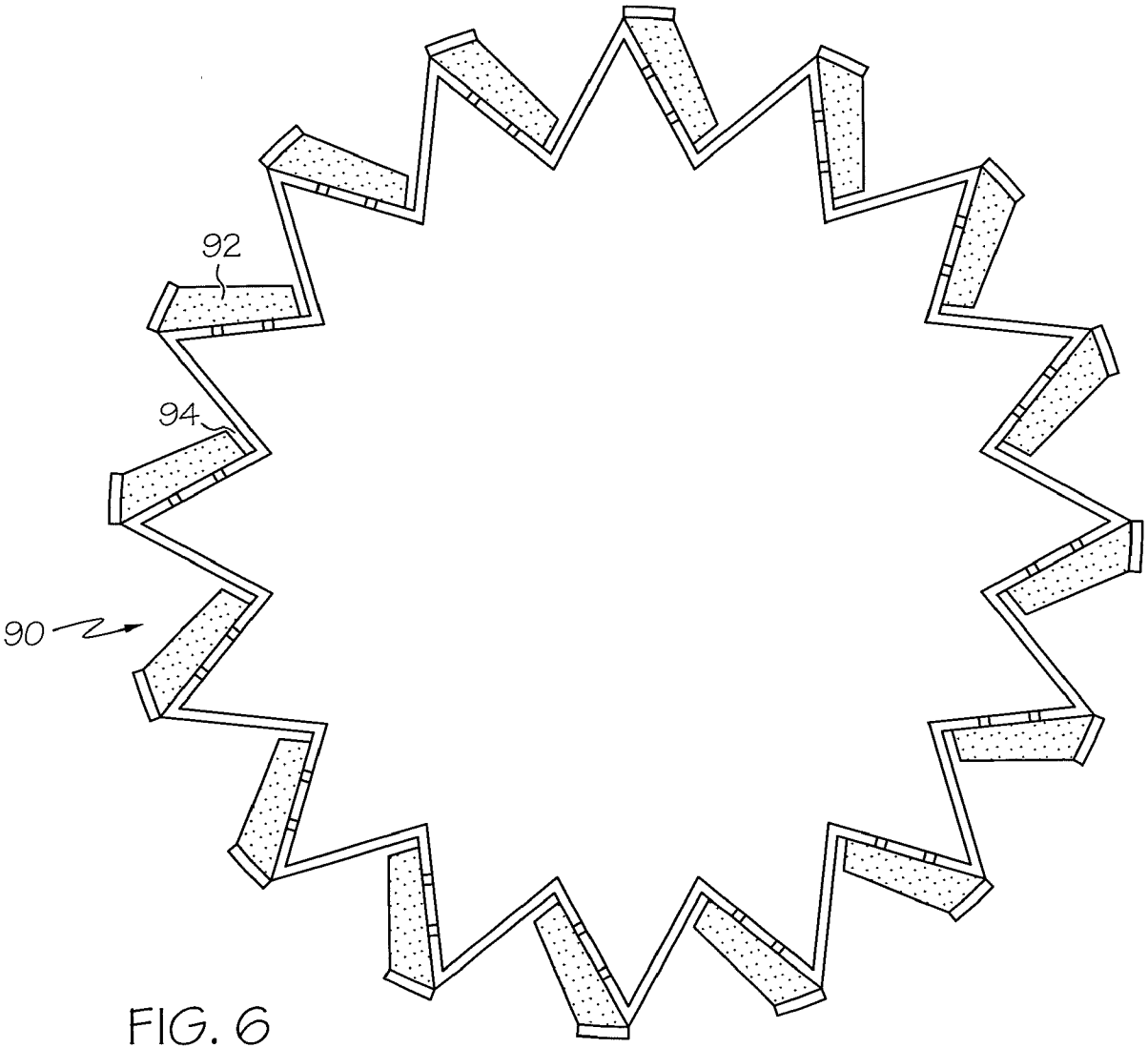
FIG. 6 is a schematic view of an expandable configuration having flow ports and a beaded matrix.

Referring to FIG. 6, an expandable liner 90 is illustrated having a number of beaded matrix areas 90 supplied thereon. These areas 92 are intended to be permeable or renderable impermeable as desired through means noted above but in addition allow the liner to be expanded to a generally cylindrical geometry upon the application of fluid pressure or mechanical expansion force. The liner 90 further provides flex channels 94 for fluid conveyance. Liner 90 provides for easy expansion due to the accordion-like nature thereof It is to be understood, however, that the tubular of FIG. 2 is also expandable with known expansion methods and due to the relatively small change in the openings in tubular 40 for devices 10, the devices 10 do not leak.

It is noted that while in each discussed embodiment the matrix 14 is disposed within a housing 12 that is itself attachable to the tubular 40, it is possible to simply fill holes in the tubular 40 with the matrix 14 with much the same effect. In order to properly heat treat the tubular 40 to join the beads however, a longer oven would be required.

While preferred embodiments have been shown and described, modifications and substitutions may be made thereto without departing from the spirit and scope of the invention. Accordingly, it is to be understood that the present invention has been described by way of illustrations and not limitation.

The invention claimed is:

1. A fluid media tell-tale configuration comprising:

a tubular having an inside surface with which a fluid media will make contact during application of the fluid media to a target destination;

one or more openings in the tubular having a beaded matrix therein, the beaded matrix being permeable to a fluid transport component of the fluid media while being impermeable to a residue component of the fluid media, the residue in use being left at an outside dimension surface of the tubular.

2. The configuration as claimed in claim 1 wherein the beaded matrix is disposed in a plug housing, the housing being engaged with the tubular.

3. The configuration as claimed in claim 1 wherein the beaded matrix is disposed directly in the one or more openings of the tubular.

4. The configuration as claimed in claim 1 wherein the tubular includes an open entrance pathway for fluid media and an exit pathway through the one or more openings having the beaded matrix therein.

5. The configuration as claimed in claim 1 wherein the tubular includes one or more beaded matrix entrance passages permeable to both the transport component and the residue component of the fluid media.

6. The configuration as claimed in claim 1 wherein the one or more openings are paired with one or more entrance passageways a plurality of times to facilitate residue component being left in more than one discrete target location simultaneously.

7. The configuration as claimed in claim 1 wherein the fluid media is cement.

8. The configuration as claimed in claim 1 wherein the fluid media is hardenable.

9. A method for applying a fluid media to a target location with a tell-tale confirmation comprising:

pumping a fluid media to a target location;

urging the fluid through a tubular and into an annulus of the tubular and then to one or more openings in the tubular having a beaded matrix therein, the beaded matrix being permeable to a transport portion of the fluid media and impermeable to a residue portion of the fluid media;

monitoring the fluid media for a pressure increase.

10. The method as claimed in claim 9 wherein the urging occurs through one or more entrance passageways that are open.

11. The method as claimed in claim 10 wherein the one or more entrance passageways include a beaded matrix therein that is permeable to both the transport component and the residue component of the fluid media and the urging includes moving the fluid media through the entrance passageways beaded matrixes and the one or more openings having beaded matrixes therein.

12. The method as claimed in claim 9 wherein the monitoring is utilized in a determination of level of completion of a target operation.

13. A fluid media tell-tale configuration comprising:

a tubular having an inside surface with which a fluid media will make contact during application of the fluid media to a target destination; and one or more openings in the tubular having a beaded matrix therein, the beaded matrix being permeable to a fluid transport component of the fluid media while being impermeable to a residue component of the fluid media wherein the one or more openings are paired with one or more entrance passageways a plurality of times to facilitate residue component being left in more than one discrete target location simultaneously.

14. A cement media tell-tale configuration comprising:

a tubular having an inside surface with which the cement media will make contact during application of the cement media to a target destination; and one or more openings in the tubular having a beaded matrix therein, the beaded matrix being permeable to a fluid transport component of the cement media while being impermeable to a residue component of the cement media.

15. A method for applying a fluid media to a target location with a tell-tale confirmation comprising:

pumping a fluid media to a target location;

urging the fluid through one or more entrance passageways that are open to one or more openings in a tubular having a beaded matrix therein, the beaded matrix being permeable to a transport portion of the fluid media and impermeable to a residue portion of the fluid media and wherein the one or more entrance passageways include a beaded matrix therein that is permeable to both the transport, component and the residue component of the fluid media and the urging includes moving the fluid media through the one or more entrance passageway beaded matrixes and the one or more openings having beaded matrixes therein; and monitoring the fluid media for a pressure increase.

* * * * *